US006009731A

United States Patent [19]

Emmons et al.

[11] Patent Number: 6,009,731

[45] Date of Patent: Jan. 4, 2000

[54] LOCKING DEVICE FOR DOOR KEEPER BAR

[75] Inventors: Robert F. Emmons, Kiowa, Colo.; Craig Hamilton, Waterloo; Terrence N. Brammall, Angola, both of Ind.

[73] Assignee: Transguard Industries, Inc., Angola, Ind.

[21] Appl. No.: 09/080,550

[22] Filed: May 18, 1998

Related U.S. Application Data

[63] Continuation-in-part of application No. 08/909,247, Aug. 11, 1997, Pat. No. 5,878,604.

[51] Int. Cl.[7] ..... E05B 67/38

[52] U.S. Cl. ..... 70/56; 70/2; 70/212; 70/417; 292/205; 292/281; 292/282; 292/DIG. 32

[58] Field of Search ..... 70/54–56, 2–13, 70/417, 202, 203, 211, 212; 292/281–287, DIG. 32, 205, DIG. 36, 218, 327

[56] References Cited

U.S. PATENT DOCUMENTS

| | | | |
|---|---|---|---|
| 3,151,898 | 10/1964 | Olander | 292/DIG. 32 X |
| 3,656,789 | 4/1972 | Ray | 70/417 X |
| 3,736,016 | 5/1973 | Garvey et al. | 70/56 X |
| 4,437,692 | 3/1984 | Halopoff | 70/56 X |
| 4,581,907 | 4/1986 | Eberly | 292/205 X |
| 4,742,701 | 5/1988 | Scavetto | 70/54 X |
| 4,911,486 | 3/1990 | Anderson | 70/54 X |
| 5,154,458 | 10/1992 | Cook et al. | 70/417 X |
| 5,307,653 | 5/1994 | Davis | 70/56 |
| 5,388,435 | 2/1995 | Bailey | 70/202 X |
| 5,737,946 | 4/1998 | Sole et al. | 70/56 X |
| 5,743,118 | 4/1998 | Anderson | 70/56 |
| 5,791,702 | 8/1998 | Liroff | 70/202 X |

*Primary Examiner*—Lloyd A. Gall
*Attorney, Agent, or Firm*—William Squire

[57] ABSTRACT

A steel plate hasp is permanently fixedly attached to a door keeper bar, the bar for rotating about its longitudinal axis between door closed and open states. A casing has a plurality of walls forming a housing cavity in which the hasp is received through an opening in a housing wall with bolt seal shank apertures aligned in the hasp and housing. The casing may be permanently secured to the door by bolts or welds or may be selectively attached and removed from the hasp in a locked and unlocked state without fixed attachment to the door. A bolt seal has a shank with a head at one end wherein the head engages a housing wall and a locking body engages and locks to the shank other end and to a further housing wall. The shank between the head and lock body is fully enclosed by the housing and door to preclude access to the shank by tampering tools. The casing when secured to the hasp cooperates with the door to prevent the keeper bar from rotating open. The hasp rotates within the housing cavity of the permanent type casing. Other casing embodiments are disclosed for use with different latch hasps.

20 Claims, 5 Drawing Sheets

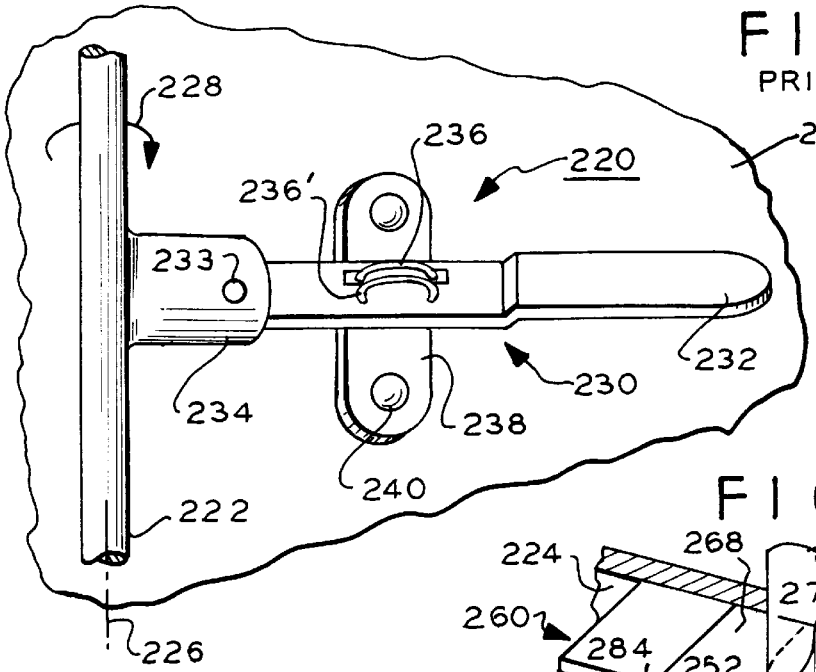
FIG. 15
PRIOR ART
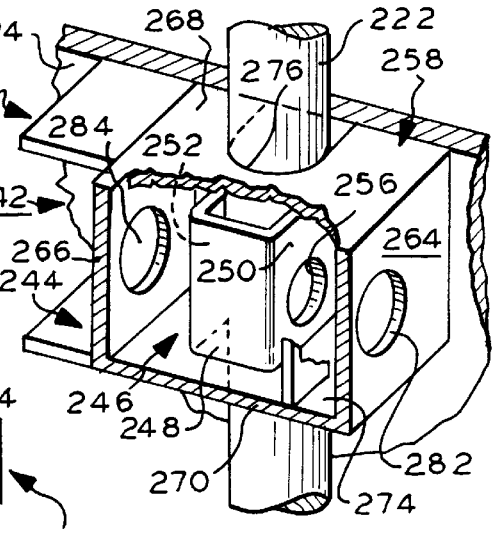
FIG. 21
FIG. 16a
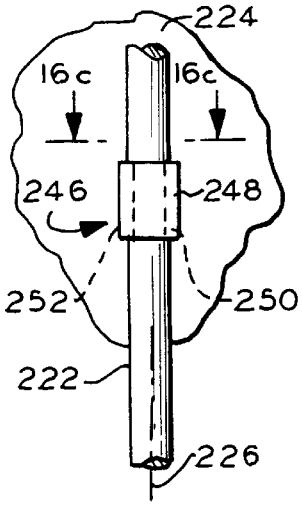
FIG. 16b
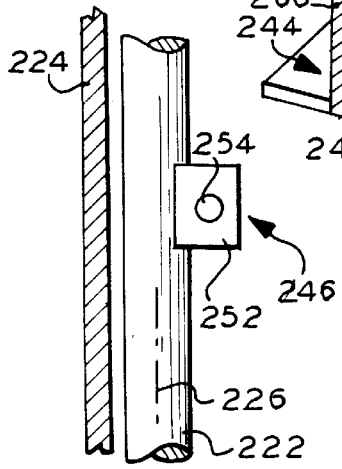
FIG. 22
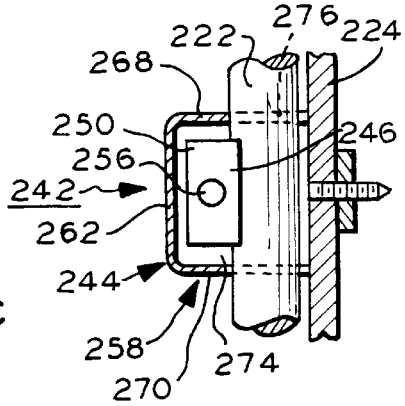
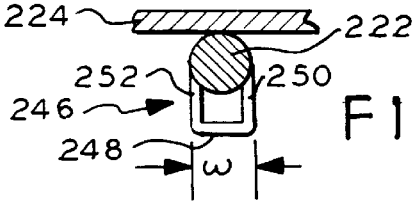
FIG. 16c

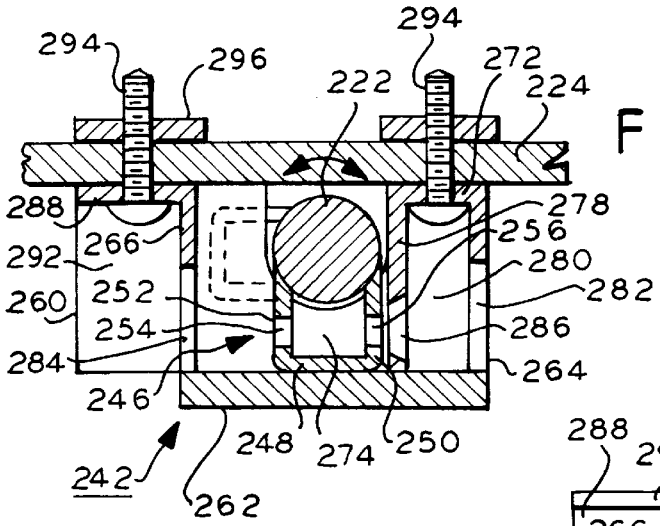
FIG. 19
FIG. 20
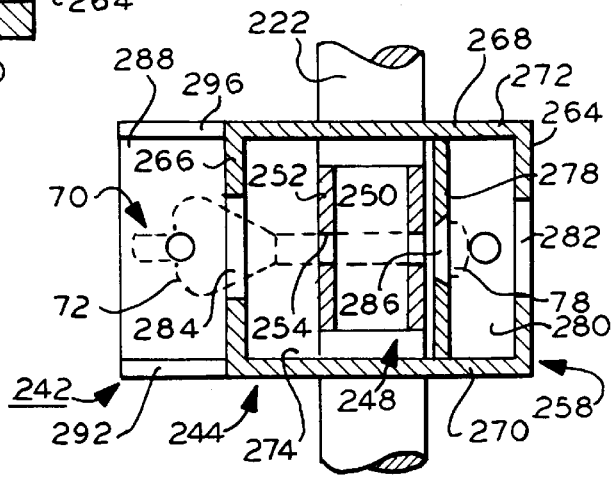
FIG. 17
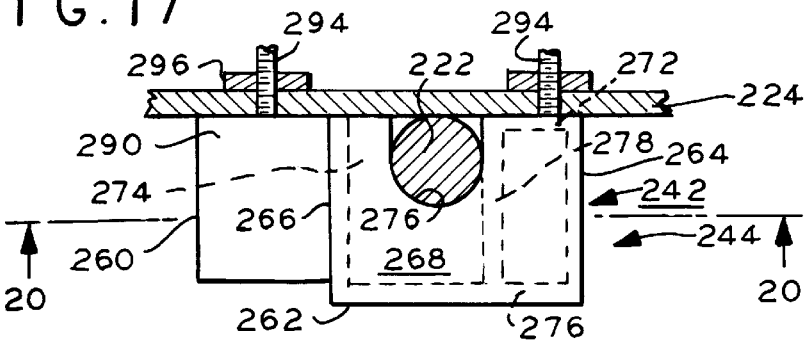
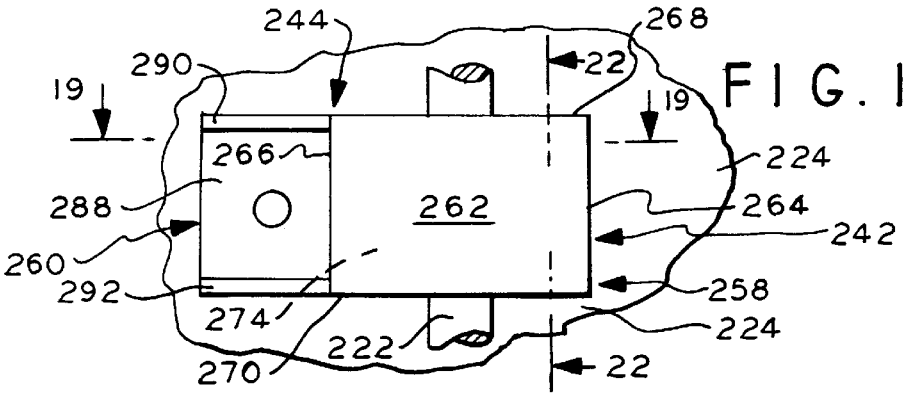
FIG. 18

LOCKING DEVICE FOR DOOR KEEPER BAR

This application is a continuation-in-part of application Ser. No. 08/909,247 filed Aug. 11, 1997, now U.S. Pat. No. 5,878,604.

This invention relates to bolt seal locking devices, and more particularly, to devices including seal protectors for use with bolt seals for locking door keeper bars.

Of interest are commonly owned U.S. Pat. Nos. 5,413,393 and 5,347,689, both in the name of Georgopoulos et al. and U.S. Pat. No. 5,732,989, in the name of Stevenson et al., all incorporated by reference herein.

Cargo shipping vehicles and containers are subject to widespread tampering due to the value of the cargo. Thieves break open conventional bolt seals which comprise a steel bolt shank to which a head is swaged at one end and to which a locking body containing a lock mechanism is locked at the other end. The shanks are subject to relatively easy tampering by way of bolt cutters or cutting torches. The problem is aggravated by the fact that different rail cars, trucks and cargo containers, for example, may employ different types of latches and hasps.

In some case, doors are secured by keeper bars, for example. A keeper bar is an elongated rod rotatable between closed and open states. The ends of the bars form one type of latch with the door frame for securing a door closed. A handle is used to rotate the keeper bar and is secured closed by a second type of latch. A typical handle latch for such doors is illustrated in FIG. 15. In FIG. 15, a latch assembly 220 comprises a keeper bar 222 which is secured to a door 224 by clamps (not shown) for manual rotation about its longitudinal axis 226. The bar 222 in the one angular position shown is in a door locked state. When rotated 90° in direction 228 about axis 226, the bar 222 ends (not shown) disengage a locking arrangement (not shown) permitting the door to swing open in a known manner.

A handle assembly 230 is secured to the bar to facilitate rotation of the bar. Assembly 230 includes a handle 232 pivoted at pin 233 to link 234 welded to the bar 222. A hasp 236, a wire loop, is secured to a plate 238 which is fastened to the door 224 by rivets 240 or bolts. A second wire loop hasp 236' is secured to the handle 232 which has an opening through which the hasp 236 passes juxtaposed with hasp 236'. A padlock or seal bolt (not shown) is passed through the loops of the two hasps to lock the handle in the position shown. The locked handle prevents it and thus the keeper bar from being rotated to the bar opened unlocked state. The rivets holding the plate 238, the padlock or bolt seal, or the hasps are all exposed for tampering to unlock the handle and permit the keeper bar 222 to be rotated open.

To help alleviate the problem of access to the seals, seal protectors are available to further protect the seals from tampering access.

For example, U.S. Pat. No. 5,413,393 illustrates a bolt seal and a tool for breaking the shank at the head end of the shank. The tool engages the head and manually bends the shank which breaks due to serrations in the shank. In the aforementioned U.S. Pat. No. 5,732,989, a locking seal employs a steel bolt with a head at one end and grooves along the bolt shank for use with a locking body containing a releasable locking mechanism which engages the grooves. The mechanism is released by a disclosed mating specially designed tool and which locking body mechanism is otherwise difficult to release and is relatively tamper resistant.

U.S. Pat. No. 5,347,689 shows a further bolt seal configuration using a bolt and locking body and which requires a tool similar to the tool of the '393 patent tool to break the seal shank. Other seals are known wherein tool cutters are required to cut the bolt shank.

In U.S. Pat. No. 5,118,149, a container hasp protector is disclosed. A metal box-like body has a top plate, a bottom plate, right and left side plates, an open rear face and a front face. A shield plate is on the front face and extends between the side plates forming a top opening in the face between the shield plate and top plate and a bottom opening in the face between the shield plate and the bottom plate. The body is arranged to protect the hasp from intentional breakage.

The shield plate has an aperture which cooperates with aligned apertures in a hasp to receive a breakaway security seal. The problem with this device as recognized by the present inventors is that while the hasp is protected, the shank of the seal is exposed via the openings in the front face. These openings are provided so that an authorized user can break the seal by cutting the shank. The problem is that the exposed shank permits tamperers to use bolt cutters or torches to readily cut the seal shank.

The present inventors recognize that potential thieves do not like to tamper with locks that are difficult to open, especially locks on cargo doors which may be subject to periodic surveillance. If the locks can not be opened in a few minutes, thieves are likely to pass up such tampering. For this reason the device of the '149 patent is believed not desirable for valuable cargo containers and the like.

U.S. Pat. No. 3,951,443 discloses a security lock that employs a locking pin. The lock employs interengaged keepers with aligned through apertures which receive the pin. One of the keepers has a through pilot hole in the face thereof so that the pin can be cut apart with a heavy duty power drill for use by an authorized person. The only way for the lock to be opened is by destroying the pin. This is not satisfactory because the locking pin is destroyed rather than capable of reuse. More importantly, it is disclosed that thieves would not like to use a noisy, inconvenient and conspicuous power drill. However, portable cutting torches may also be used to cut the pin via the pilot hole. This is believed unsatisfactory.

Padlock protector devices are disclosed in U.S. Pat. Nos. 4,898,008, 4,033,155, 5,146,771, and 5,477,710. These also are not satisfactory for cargo shipping containers or rail cars because the shackles are readily exposed for destruction by a tamperer. Further these devices are not disclosed as operative with bolt seals of the type described above.

The present inventors recognize a need for a cost effective seal and latch protection device which uses cost effective reusable locking bodies or reusable bolts and locking bodies for use with keeper bars. They recognize a need for a protection device which precludes access to the bolt shank which is vulnerable to tampering while at the same time locking a door keeper bar more securely than present latch locking devices.

A locking device according to one aspect of the present invention is for use with a rotating keeper bar for an enclosure door and a locking seal, the keeper bar for rotation to door open and locked states, the seal comprising a shank having opposing ends with locking means at one shank end and a locking body selectively locked to the shank at the opposing shank end. The device comprises a hasp having at least one seal shank receiving aperture, the hasp for being fixedly secured to and for rotation with the keeper bar to the open and closed states and a housing having a plurality of walls defining a cavity, a first housing wall having an opening for releaseably receiving the hasp and keeper bar in the cavity.

At least one second housing wall has an aperture juxtaposed with the received hasp at least one aperture for receiving the shank therethrough. The seal locking means and lock body locking the received hasp to the housing at least one second wall. The housing includes means cooperating with the door for precluding rotation of the keeper bar in the seal locked state.

The housing and hasp in one aspect include means arranged so that the shank and hasp in the cavity between the locking head and the locking body are substantially enclosed to preclude access to the shank by tampering tools.

In a further aspect, the cavity is dimensioned to permit the hasp to rotate within the cavity as the keeper bar is rotated in the unlocked state.

Preferably, the hasp is metal and the keeper bar is an elongated rod, the hasp for weld attachment to the keeper bar.

The housing at least one second wall in a further aspect comprises juxtaposed plate members forming housing top and bottom walls, the plate members each having a shank receiving aperture aligned with the received at least one hasp aperture.

The locking means may comprise a head secured to the shank, the housing including a further plate member in the cavity intermediate the housing top and bottom walls, the further plate member having a further aperture for receiving the shank therethrough aligned with the juxtaposed top and bottom wall apertures, the top wall aperture being enlarged relative to the further aperture for receiving the head therethrough so that the received head is in the cavity intermediate the top wall and further plate member.

The locking body in a further aspect includes a tapered portion, the bottom wall aperture being enlarged relative to the shank to receive and engage the tapered portion.

The further aperture preferably has a tapered portion, the head including a tapered portion for engaging the aperture tapered portion.

In a further aspect, the housing plurality of walls include opposing side walls, a rear wall and a front wall secured to the at least one second wall, the at least one second wall comprising a bottom wall, a top wall and an intermediate wall between the top and bottom walls, the opening for the hasp being in the rear wall, the bottom, top and intermediate walls all having an aperture for receiving the shank.

In a further aspect, means are provided for fixedly securing the housing to the door with the hasp received in the cavity.

In a still further aspect, the locking means head and the top wall each having complementary tapered surfaces.

IN THE DRAWING:

FIG. 15 is an isometric view of a prior art door and keeper bar latch assembly;

FIGS. 16*a*, 16*b* and 16*c* are respective front elevation, side elevation and top plan sectional views of the keeper bar of FIG. 15 with a hasp attached according to a fourth embodiment of the present invention, FIG. 16*c* being taken along lines 16*c*—16*c* of FIG. 16*a;*

FIG. 17 is a top plan view partially in section of a device according to the fourth embodiment of the present invention;

FIG. 18 is a front elevation view partially in section of the embodiment of FIG. 17;

FIG. 19 is a sectional plan view of the embodiment of FIG. 18 taken alone lines 19—19;

FIG. 20 is a sectional front elevation view of the embodiment of FIG. 17 taken along lines 20—20 illustrating an attached bolt seal in phantom;

FIG. 21 is an isometric sectional view of the device of FIG. 17; and

FIG. 22 is a side sectional elevation view of the device of FIG. 18 taken along lines 22—22.

Figure 1:
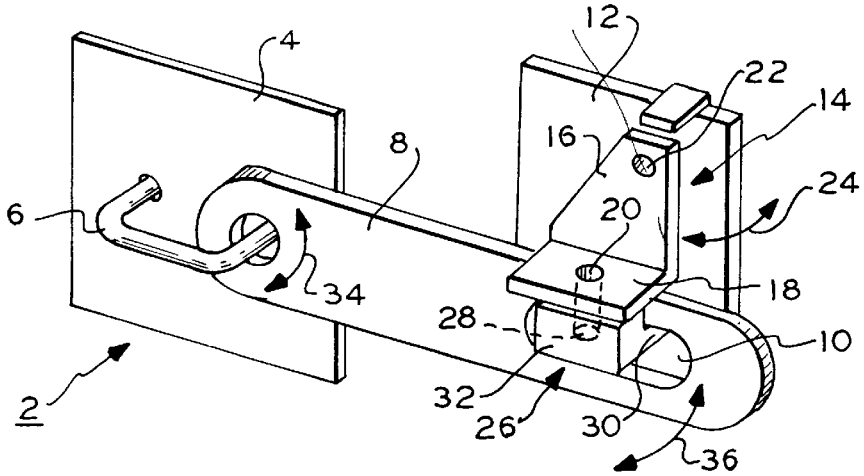
FIG. 1 is an isometric view of a bi-level and tri-level automobile rail car latch and hasp assembly.

In FIG. 1, latch 2 is a conventional existing assembly for securing two opposing doors of automobile carrying rail cars which may be bi-level or tri-level. Latch 2 comprises a sheet metal plate member 4 secured to one rail car door (not shown) and a staple 6 secured to the plate member 4. An elongated sheet metal latch member 8 has a hole through which is loosely attached staple 6 and has a slot 10 at the end distal the staple 6. A second sheet metal plate member 12 is secured to the other rail car door (not shown).

A hasp assembly 14 comprises a first L-shaped hasp 16 having a leg 18 with an aperture 20. Hasp 16 pivots at pin 22 in directions 24. A second L-shaped hasp 26 is fixed to plate member 12. Hasp 26 leg 32 has an aperture 28 alignable with the aperture 20 of movable hasp 14. Legs 18, 30 and 32 form a channel which receives the member 8 adjacent to the slot 10, hasp 26 passing through the slot 10. The member 8 is movable in directions 34 and 36 to engage and disengage the hasp 26 after the hasp 16 is rotated in directions 24.

Figure 2:
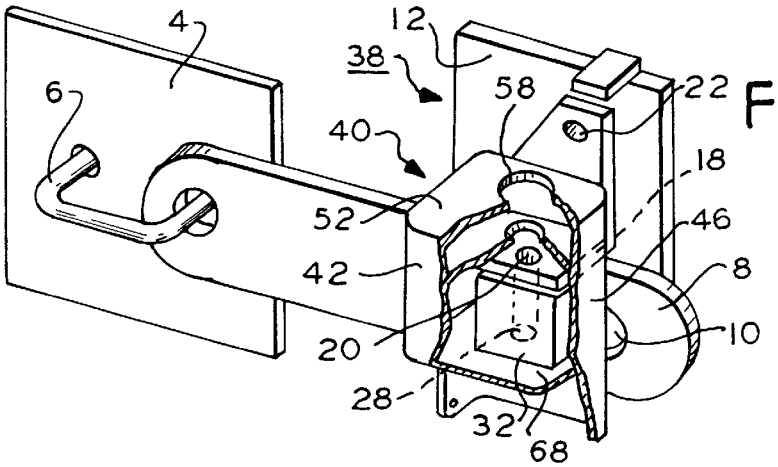
FIG. 2 is a partially in section isometric view of the latch of FIG. 1 assembled with a seal and hasp protection device according to one embodiment of the present invention without a locking bolt seal.

Seal protection device 38, FIG. 2, comprises a box-like casing or housing 40 preferably fabricated of 5/16 inch thick sheet steel plate members preferably welded together. While discrete plate members are shown, curved or rounded walls without discrete boundaries may also be used. The housing 40 has a front plate member wall 42, a rear plate member wall 44, and two opposing lateral side plate member walls 46, 48. The walls may be formed of a single sheet bent as shown and, then preferably, butt welded medially side wall 46. The walls 40, 42, 44 and 46 define a cavity 50 having a plurality of sides, a top and a bottom. The cavity top is enclosed with a top plate member wall 52 and the cavity bottom is enclosed with a bottom plate member wall 54. An intermediate wall 56 is in the cavity 50 dividing the cavity 50 into two subchambers.

Figure 4:
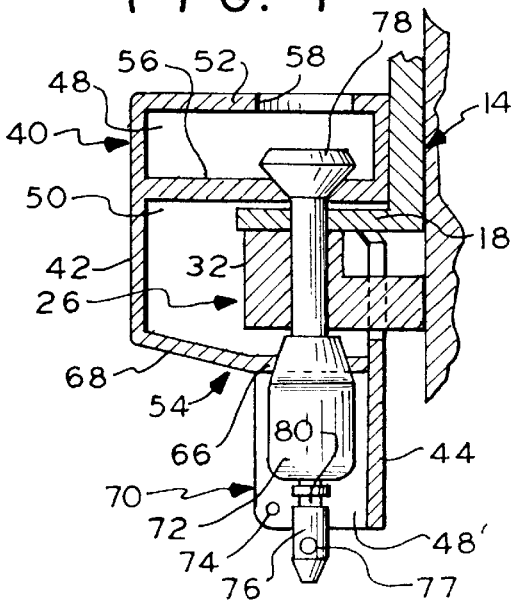
FIG. 4 is a side elevation sectional view of the device of FIG. 2 attached to the latch hasp of FIG. 1 with a locking bolt seal attached to the bolt shank and hasp in the locked mode.

The walls 52, 54 and 56 are preferably welded to the casing 40. The top wall 52 has a circular hole 58 next adjacent to wall 44. The bottom wall 54 has a circular hole 60. Wall 56 has a circular hole 62 which has a beveled edge 64. The holes 58, 60 and 62 are preferably axially aligned. Wall 54 has a rear section 66 and a front section 68. The rear section 66 is normal to all of the casing 40 walls. The front section 68 is normal to the side walls but inclined relative to the rear and front walls as best seen in FIG. 4. The rear wall 44 depends beyond the bottom wall 54 as do side walls 46 and 48.

The depending portions are coextensive with and abut bottom wall rear section 66. The depending portions form a protective region about the bolt seal 70, and in particular, about the locking body 72 containing the locking mechanism (not shown). A depending side wall 48' has a hole 74 for receiving a tamper evidencing seal (not shown).

The seal 70 is preferably releasable as more fully described in the aforementioned copending application incorporated by reference herein. In the alternative, the seal may be of other configurations which may be commercially available or of the type described in the commonly owned patents described in the introductory portion.

The seal 70 preferably comprises a circular steel shank 76 to which is swaged a locking head 78 having a frusto-conical portion tapering toward the shank 76. The frusto-conical portion mates with and nests within and against the beveled edge 64 of hole 62 in the intermediate wall 56. The head 78 has a diameter smaller than the top wall 52 hole 58 to pass therethrough. The head 78 is located in the chamber defined by walls 52 and 56. The shank 76 adjacent the other end has an axial array of annular grooves 80 which mate with the locking mechanism (not shown) of locking body 72, which mechanism is fully described in the aforementioned copending application. The shank 76 has an aperture 77 therethrough for receiving a tamper indicating seal (not shown) which is engaged also with hole 74.

The locking body 72 is formed of a steel casing which may be hardened to resist tampering and has a tapered outer surface. The smaller end of the casing is smaller than the hole 60 of bottom wall 54 so as to partially engage this hole to preclude tampering with the shank whose exposed portion between the head 78 and locking body 72 is entirely within cavity 50 between the walls 56 and 54.

The locking body mechanism has jaws (not shown) that are releasably engaged with any of the shank grooves 80. This permits the locking body 70 to enter into the hole 60 in the locked state. The locking jaws permit the body 70 to slide along the shank toward the head 78 while locked against displacement in the opposite direction unless released.

Rear wall 44 has a substantially square opening 82 except for an enlarged transverse region 84. The opening 82 receives the hasp 26 (FIG. 2) and the enlarged region 84 receives the leg 18 of the hasp 16 as best seen in FIG. 4. There may be some clearance therebetween. The received hasp apertures 20 and 28 are aligned with the holes 58, 60 and 62 of the device 38.

In operation, the bolt seal 70 shank is passed through all of the aligned apertures, with the head nested in hole 62. The locking body 72 is then attached to the shank until it seats in the hole 60 and against the bottom wall 54. The latch hasps enclose the opening 82 in the rear wall and support the device 38. As a result the shank 76 between the head 78 and seal locking body 72 is fully enclosed and inaccessible by tampering tools external the casing 40.

Figure 5:
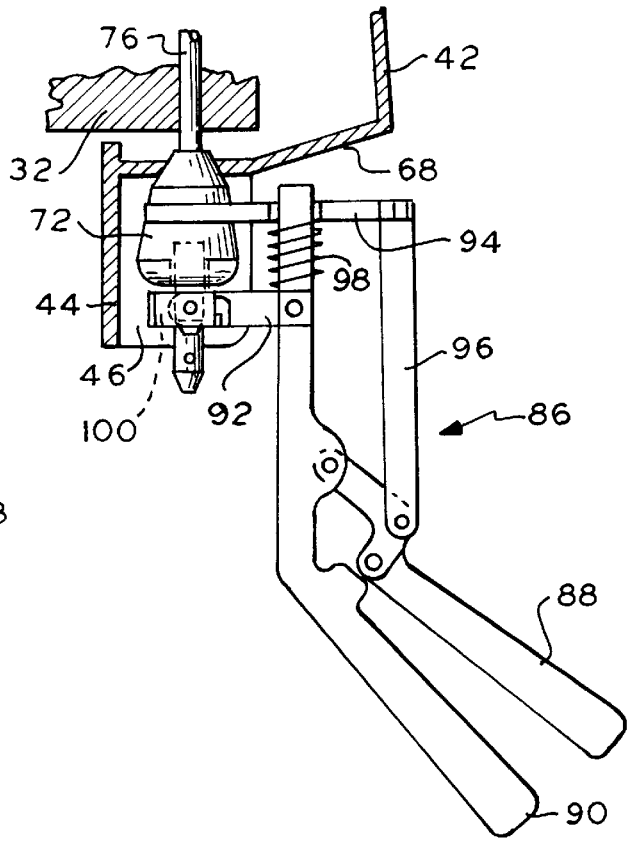
FIG. 5 is a side elevation view partially in section similar to FIG. 4 and partially fragmented showing a tool in place for releasing the locking body from the shank of the locking bolt of the device of FIG. 4.

To release the locking body 72, FIG. 5, a tool 86, as more fully described in the aforementioned U.S. Pat. No. 5,732,989, is employed. The tool 86 has a pair of squeezable handles 88, 90. A jaw 92 is secured to handle 90. A second jaw 94 is pivotally secured to handle 88 via link 96. A compression spring 98 is between the jaws. A cylinder 100 is pivotally attached to jaw 92. The cylinder 100 engages the locking body 72 internal locking mechanism employing a spring. This spring (not shown) has a high spring constant, e.g., requiring several hundred pounds force to displace. This spring keeps the locking body jaw mechanism locked. The tool 86 by manually squeezing the handles together exerts a highly leveraged force against the jaw mechanism spring to displace and unlock these jaws. The locking mechanism spring is relatively tamper resistant due to its high spring load.

The depending side wall portions such as portion 48' preclude bolt cutters from accessing the exposed locking body. The recessed head 78 is also not accessible to bolt cutters. Further, cutting torches will most likely melt and fuse the head or locking body to the casing and at best will take considerable time to free the latch of the device 38. Such increased tampering time serves as a deterrent to thieves who disdain lengthy tampering due to potential periodic surveillance. The inclination of bottom wall section 68 provides clearance access for the tool 86. The tool 86 can access the locking body 72 through the open one side of the casing 40 at the depending walls 48' which preclude easy access by more conventional tools.

Figure 3:
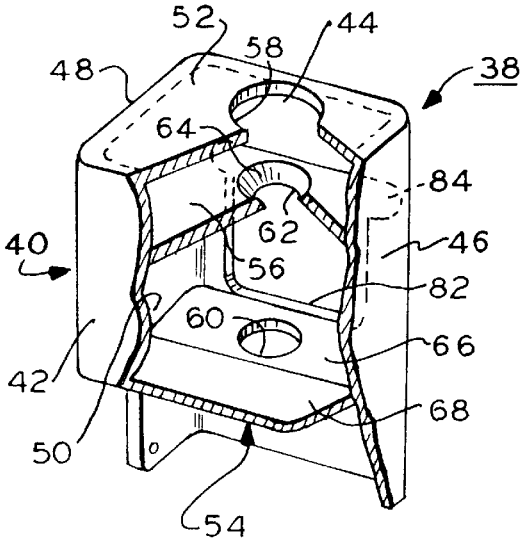
FIG. 3 is an isometric view partially in section showing in greater detail the protection device of FIG. 2 without the latch.
Figure 7:
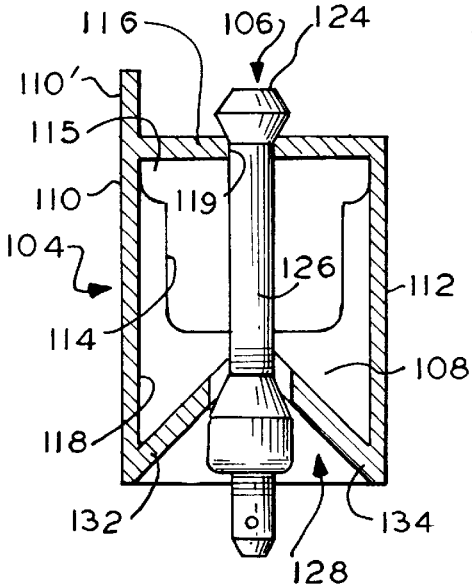
FIG. 7 is a side elevation sectional view of the device of FIG. 6 with a bolt seal and without a latch attached.
Figure 6:
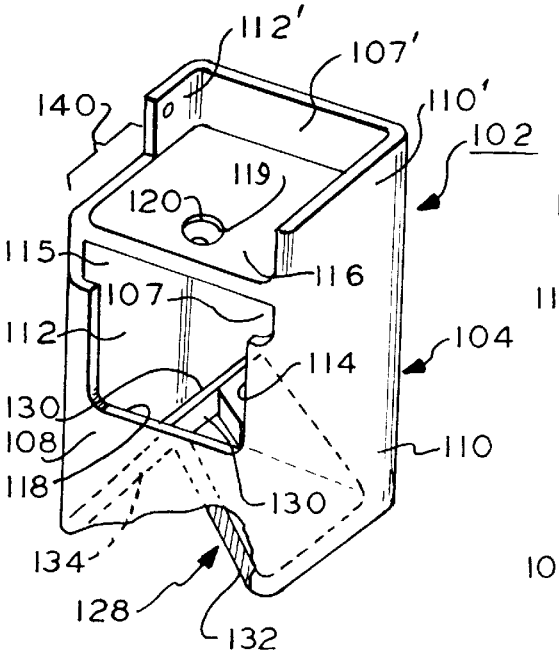
FIG. 6 is a partially in section isometric view of a protection device according to a second embodiment of the present invents for use with the latch of FIG. 1.
Figure 8:
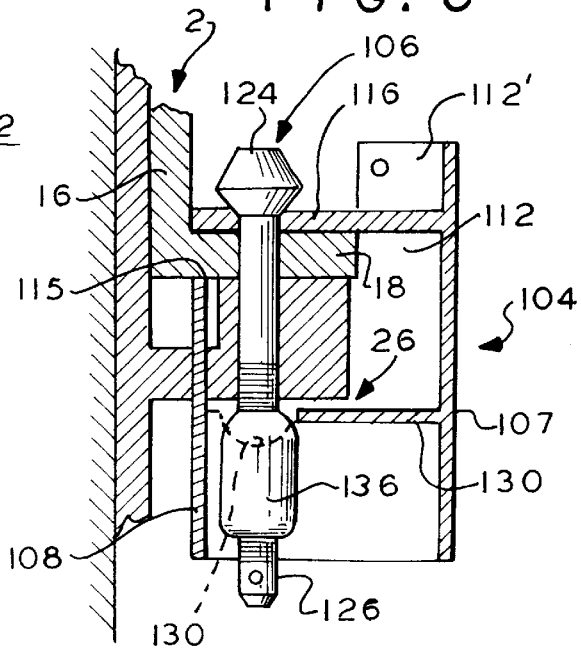
FIG. 8 is a side elevation sectional view of the device of FIG. 7 attached to the latch hasp of FIG. 1.

FIGS. 6, 7 and 8 illustrate a second embodiment comprising a protection device 102 having a housing 104 for use with a breakaway seal 106 of the type disclosed in the aforementioned U.S. Pat. Nos. 5,347,689 and 5,413,393. Housing 104 is made of sheet steel plate members similar to the housing 40 of FIG. 3, and is used with the latch 2, FIG. 1. The housing 104 has a front wall 107, a rear wall 108 and opposing lateral side walls 110 and 112. The rear wall 108 has an opening 114 identical to the opening 82 and a region 115 identical to region 84 of the housing 40, FIG. 2, for receiving the hasps 16 and 26.

A top wall 116 encloses cavity 118 at the top thereof. Top wall 116 has a hole 119 with a beveled edge 120. The edge 120 mates with and engages the received frusto-conical portion of seal 106 head 124. The seal 106 shank 126 is partially surrounded by top wall 116 with no portion exposed above the top wall 116.

Bottom wall 128 is formed of a right angle iron. The apex 130 of the wall 128 is interior the space between the front, rear and side walls closest to the top wall 116. The bottom wall 128 has two inclined sections 132 and 134 each secured to and terminating distal the apex 130 at a different respective side wall 110, 112. A lock body 136 on the seal 106 is partially received in a hole 138 in the bottom wall through the apex 130 and is adjacent to the rear wall 108. The walls being sheet steel are preferably joined by welds.

The bolt seal lock body 136 includes a locking collet (not shown) that slides up the seal 106 shank 126 in a one way clutch action. The collet engages the grooves 140 in locking engagement as described in the aforementioned patents '689 and '393. This permits a portion of the lock body casing to enter into the cavity 118 so that the shank 126 is located fully within the cavity.

To open the seal in one embodiment requires the head to be grasped by a breaking tool as described in patent '393. The shank is then bent and broken by the tool. The locking body in '393, however is reusable, and the shank discarded. The shank has no externally exposed portions outside the housing 104, the shank being the most vulnerable component in the bolt seal.

To protect the locking body 136, the bottom wall 128 forms a V-shaped recess with the front and rear walls which surround the locking body. This precludes accessing the body 136 from the sides with tampering tools. The access is only from the bottom direction which makes it more difficult to tamper with the locking body 136.

The head 124 is protected and shielded on three sides by upwardly extending respective portions 107', 110' and 112' of the front wall 107, and side walls 110 and 112. The front wall portion 107' and side wall portion 110' extend for their entire transverse extent beyond the top wall 116, FIG. 6. The side wall portion 112' extends upwardly beyond the top wall slightly less than one half of the wall 112 width from the rear to front wall to form an open region 140 above top wall 116 at the housing side. The open region above top wall 116 and the opening 114 in the rear wall 108 is shielded by the latch 2 (FIG. 1) which precludes access to the head 124 from the rear of device 102. The only side access to the head is via the open region 140 to permit use of the seal breaking tool (not shown). Tampering tool access to the head is minimized by the upward extending portions 107', 110' and 112' and to the lock body 136 by the surrounding bottom and side walls. Torch access to the head and lock body requires undesirable excessive time to defeat the locked seal.

Figure 9:
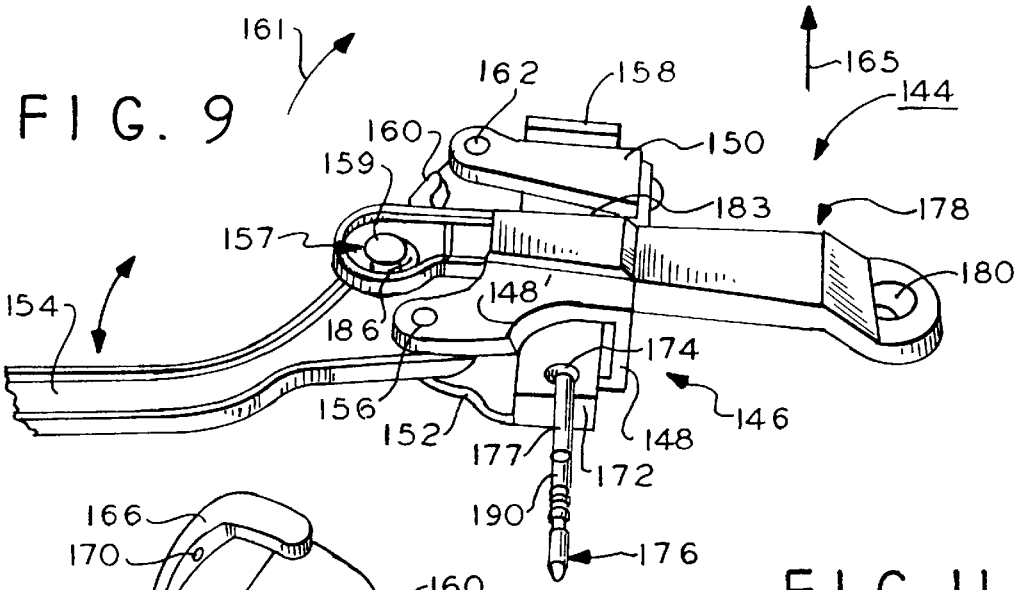
FIG. 9 is an isometric view of a latch and hasp assembly employed with box rail cars sliding doors including a bolt shank in place for use with the protection device according to a third embodiment of the present invention.
Figure 10:
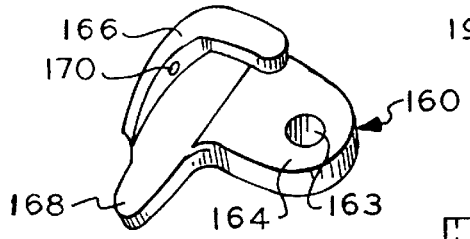
FIG. 10 is an isometric view of a component used on the latch assembly of FIG. 9.
Figure 11:
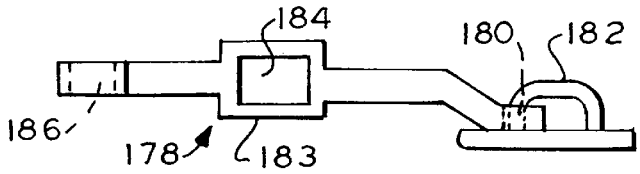
FIG. 11 is a side elevation view of a further component of the latch assembly of FIG. 9.
Figure 12:
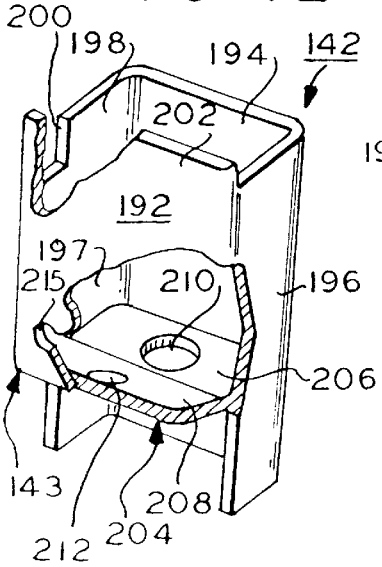
FIG. 12 is a partially in section isometric view of a protection device according to a third embodiment of the present invention for use with the latch of FIG. 9.
Figure 13:
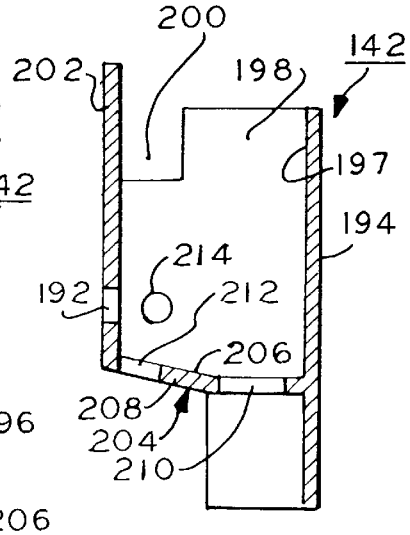
FIG. 13 is a side elevation view partially in section of the protection device of FIG. 12.
Figure 14:
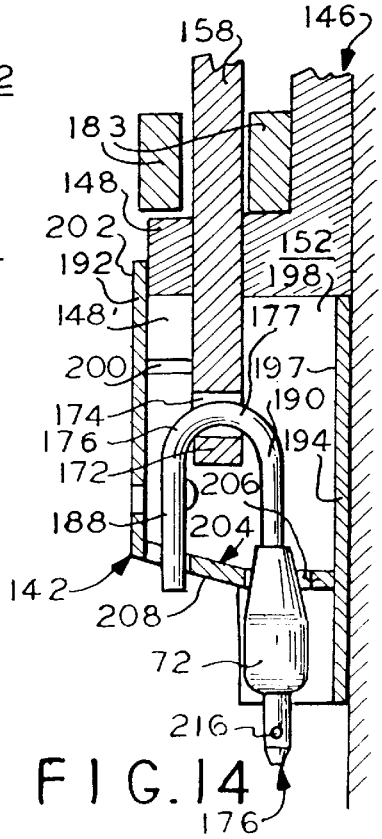
FIG. 14 is a side elevation sectional view of the device of FIG. 12 attached to the latch hasp of FIG. 9 in the locked mode with a locking bolt seal in place.

A third embodiment of a bolt seal protective device 142 is shown in FIGS. 12–14 for use with a rail box car latch 144, FIGS. 9–11. The latch 144 is used on sliding doors of box cars. The latch 144 comprises a yoke member 146 which typically is cast iron as are all of the components of the latch 144. The yoke member 146 comprises a pair of yokes 148, 150 secured by a common plate member 152. A handle 154 is pivoted to yoke 148 by pin 156. A stud 157 with an enlarged head 159 upstands from a side of the handle 154. A wedge hasp 158 locking member 160 is pivoted to yoke 150 by pin 162.

In FIG. 10, locking member 160 comprises a body 164 pinned by pin 162 via hole 163, an upstanding L-shaped rib 166 and a tongue 168. A tamper indicating seal (not shown) receiving hole 170 is in rib 166. The rib 166 and hole 170 are adjacent to the handle 154 when the wedge hasp 158 is in the locked state of FIG. 9.

The wedge hasp 158 tapers somewhat to end 172, which end forms a hasp. The end 172 has a hole 174 for receiving a locking bolt 176 of the present invention, or as in the prior art, for receiving the shackle of a padlock (not shown) or a conventional bolt seal shank of the representative type shown in the '393 patent, for example. The hasp 158 is passed through the yokes 148 and 150 in the locking state. In this locked state, the locking member 160 is pivoted to the position shown in FIG. 9 with the tongue 168 engaged with a recess (not shown) in a side of the wedge hasp 158.

In the unlocked state, the locking member 160 is pivoted in direction 161 about pin 162 to disengage tongue 168 from the wedge hasp recess. The wedge hasp 158 is then free to be disengaged from the yokes 148 and 150 in direction 163. All of the above described structure of the latch 144 is secured to the side of a box car stationary wall.

A sliding door securing bar 178, FIG. 11, is cast iron and elongated. The bar 178 has an aperture 180 at one end for receiving a staple 182 secured to the box car door (not shown), the staple movably locking the bar 178 to the door. The bar 178 has a somewhat centrally located enlarged portion 183 with a rectangular opening 184 which receives therethrough the wedge hasp 158, FIG. 9, in the locked state. The end of the bar 178 distal staple 182 has an aperture 186 for receiving the stud 157. The handle 154 has a seal receiving opening (not shown) to receive the tamper indicating seal which is engaged with the hole 170 of the locking member 160 in the locked state. Prior art bolt seals locked to the hasp hole 174 are easily defeated by thieves because the shanks are exposed for breakage.

The handle 154 pivots about pin 156 to cam the door shut with the locking member 160 in the unlocked state. The locking member 160 is then pivoted to the locking state of FIG. 9.

The protection device 142 according to this embodiment employs bolt 176, which has a 180° bight 177, FIG. 14. The bight 177 sits within the hole 174 of the wedge hasp 158 (FIG. 9). The bolt 176 has a short shank portion 188 and a long shank portion 190. The long portion 190 has an axial array of circular grooves 192 the same as grooves 80 in shank 76 (FIG. 4). These grooves are for releasable locking engagement with locking body 72 described above and in U.S. Pat. No. '989.

The protection device 142, FIGS. 12 and 13, comprises a sheet metal housing 143, preferably steel, including a front plate member wall 192, a rear plate member wall 194 and two opposing lateral side walls 196, 198. These walls form a cavity 197 having four sides, a top and a bottom. The side wall 198 has a notch 200. The front wall 192 has a top portion 202 that extends toward the top of the device 142 higher than the side and rear walls. The cavity 197 bottom is enclosed by bottom wall 204.

Bottom wall 204 is formed with a rear plate member section 206 normal to all of the walls and a front plate member section 208 normal to the side walls and inclined to the front and rear walls. The rear section 206 has an aperture 210 for receiving a portion of the locking body 72 and the bolt 176 long bolt portion 190. The front section 208 has an aperture 212 for receiving the bolt 176 short portion 188. In similar fashion to the device 38, FIG. 3, the rear and side walls depend below the bottom wall 204 to form a U-shaped protective region for the locking body 72. A portion of the locking body 72 enters and engages the aperture 210 in the locked state.

In operation, the bolt 176 is first inserted in the wedge hasp hole 174 as shown in FIG. 9 after the latch 144 is placed in the locked state of FIG. 9. The device 142 cavity 197 is open at the top for receiving the latch 144 wedge hasp 158. The yoke 148 abuts the upper portion 202 of the front wall and overlies and encloses the open top of the cavity 197, FIG. 14. The yoke 148 has a leg 148' (FIG. 9) which engages and encloses the notch 200.

A cable (not shown) is engaged with holes 214 and 215 in respective side wall 198 and front wall 192, FIGS. 12 and 13. The cable attaches the device 142 to a rail car. Hole 216, FIG. 14, in the shank of the bolt 176 receives a tamper indicating seal (not shown). The latch 144 fully encloses the bolt 176 in the region at the bight 177 to the locking body 72, precluding tampering access to the bolt to break the bolt open. While the bolt shank portion 188 is exposed through the bottom wall 204, this portion is harmless with respect to breaking the bolt 176 by tampering.

The bolt locking means in the claims corresponds to the bight 186 in this embodiment as compared to the bolt heads 78 and 124 in the other embodiments described hereinabove. As in the embodiment of FIG. 4, the bolt locking means is enclosed to preclude tampering. In the embodiment of FIG. 14, the bolt locking means, i.e., the bight, is fully enclosed. In the embodiment of FIG. 4, the bolt head locking means is partially enclosed due to the presence of hole 58. Tests on rail cars exhibiting 10% breaking and entering with prior art bolt seals exhibited no breakage of the seals on rail cars sealed with the device 142.

In FIGS. 17–22, device 242 comprises a seal protective casing 244 and a hasp 246 which is preferably welded to keeper bar 222. In FIGS. 16*a*–16*c*, hasp 246 is preferably steel sheet material and U-shaped. Hasp 246 comprises a transverse base member 248 and two spaced parallel legs 250, 252. The legs 250, 252 are welded at their edges distal the member 248 to the keeper bar 222 with the plane of the legs parallel to the keeper bar longitudinal axis 226. The plane of the base member 248 is also parallel to the keeper bar axis.

A seal shank 126 (FIG. 8) receiving aperture 254 is in leg 252 and a preferably identical seal shank receiving aperture 256 is in leg 250 aligned with aperture 254. The hasp 246, FIG. 16*c*, has a width w of about the same as or slightly greater than the diameter of the keeper bar 222 which is a circular cylindrical rod-like member. While the hasp 246 is shown with two legs, more or fewer legs may be employed according to a given implementation. For example, the hasp may comprise a solid single flat plate (not shown) welded at an edge to the keeper bar with the hasp plane parallel to the bar axis. The hasp 246 is thus permanently attached to the keeper bar 222.

Casing 244 comprises steel plates welded together to form a housing 258 from which a U-shaped lock body shield 260 extends. The housing 258 has a front wall 262, a pair of opposing first and second respective side walls 264 and 266, a top wall 268, a bottom wall 270 and a rear wall 272. The housing 258 has a cavity 274 formed by the side, top and bottom walls.

The top wall 268 has a U-shaped recess 276, FIG. 17. A similar recess is in the bottom wall. These recesses receive the keeper bar as shown in the figures so that the keeper bar is generally flush with the rear wall 272 outer surface or recessed into the cavity 274 somewhat relative to the rear wall 272, FIG. 19.

An intermediate steel plate internal wall 278, FIGS. 19 and 20, is in the cavity 274 and is welded at its edges to the top, bottom, front and rear walls dividing chamber 274 into subchambers and forming a secondary chamber 280 in chamber 274. Side wall 264 has a seal head 78 receiving aperture 282 through which the seal head 78 passes into chamber 280, FIG. 20. Side wall 266 has a locking body 72 receiving aperture 284 in which the body is partially received. Apertures 282 and 284 function similar to the holes 58 and 60, respectively, of the FIG. 3 embodiment.

Intermediate wall 278 has an aperture 286 having a beveled edge for receiving the tapered portion of the seal head 78, FIG. 20. The lock body 72 shield 260 comprises walls 288, 290 and 292.

A bolt 294, FIG. 19, extends through a corresponding opening in the rear wall 272 and in the shield wall 288. The bolts 294 are attached to the door 224 by nuts 296 or, in the alternative, the bolts may be omitted and the casing 244 need not be attached to the door. In place of bolts, the casing 244 may be welded or riveted to the door for a more permanent installation. The casing may be temporarily attached to the door 224 via the seal 70 and hasp 246 or permanently via the bolts or welds.

In operation, the casing 244 is placed over the hasp 246 with the hasp received in the cavity 274. The bolt seal 70 is then attached to the casing as illustrated in FIG. 20. The casing 244 abuts or is closely spaced to the door 224 (FIG. 17) so that once the hasp is secured to the casing 244 with the seal, the keeper bar can not be rotated since such rotation requires the casing to also rotate. The casing can not rotate because of its close proximity to the door. The keeper bar 222 is locked to the casing 244 by the seal 70 and the hasp 246.

Should the casing be permanently attached to the door 224, the hasp 246, FIG. 19, is free to rotate as shown in phantom within the housing cavity 274 once the seal 70 is disengaged.

The illustrated embodiments are for illustration and not limitation. It will occur to those of ordinary skill that various modifications may be made to the disclosed embodiments without departing from the scope of the invention defined by the appended claims. For example, steel plate members are illustrated but other high strength materials may be used. By way of further example, the device need not have defined separate sides as shown but may be curved which curves inherently include sides and walls as claimed.

What is claimed is:

1. Locking and seal protection device for use with a rotating keeper bar for an enclosure door and a locking seal, the keeper bar for rotation to door open and locked states, the seal comprising a shank having opposing ends with locking means at one shank end and a locking body selectively locked to the shank at the opposing shank end, the device comprising:

a hasp having at least one seal shank receiving aperture, said hasp for being fixedly secured to and for rotation with said keeper bar to said open and locked states; and a housing having a plurality of walls defining a cavity, a first housing wall having an opening for releaseably receiving said hasp and keeper bar in said cavity;

at least one second housing wall having an aperture juxtaposed with said received hasp at least one aperture for receiving said shank therethrough, the seal locking means and locking body for locking the received hasp to the housing second wall, said housing including means cooperating with said door for precluding rotation of the keeper bar in the seal locked state.

2. The device of claim 1 wherein said housing and hasp include means arranged so that said shank and hasp in the cavity between said locking means and said locking body are substantially enclosed to preclude access to the shank by tampering tools.

3. The device of claim 1 wherein said cavity is dimensioned to permit said hasp to rotate within said cavity as the keeper bar is rotated in the open state.

4. The device of claim 1 wherein said hasp is metal and the keeper bar is an elongated rod, said hasp for permanent attachment to the keeper bar.

5. The device of claim 1 wherein said housing at least one second wall comprises juxtaposed plate members forming housing opposing first and second side walls, said plate members each having a shank receiving aperture aligned with the received at least one hasp aperture.

6. The device of claim 5 wherein said locking means comprises a head secured to the shank, said housing including a further plate member in said cavity intermediate said housing opposing first and second side walls, said further plate member having a further aperture for receiving said shank therethrough aligned with said juxtaposed first and second opposing side wall apertures, said first wall aperture being enlarged relative to said further aperture for receiving said head therethrough so that the received head is in said cavity intermediate said first wall and further plate member.

7. The device of claim 5 wherein the locking body includes a tapered portion, the second side wall aperture being enlarged relative to the shank diameter to receive and engage said tapered portion.

8. The device of claim 6 wherein the further aperture has a tapered portion, said head including a tapered portion for engaging said further aperture tapered portion.

9. The device of claim 1 wherein the at least one second housing wall comprises first and second plate members each having a wall aperture for receiving the shank therethrough, the plurality of walls including a plurality of side walls, one of which forming said first housing wall, said first and second plate members for respectively enclosing the cavity sides, the second plate member aperture for receiving and engaging a portion of said locking body.

10. The device of claim 1 wherein the housing plurality of walls include opposing side walls, a rear wall and a front wall secured to the at least one second wall, the at least one second wall comprising a first side wall, a second side wall and an intermediate wall between the first and second side walls, the opening for the hasp being in the rear wall, the first, second and intermediate walls all having an aperture for receiving the shank.

11. The device of claim 1 including means for fixedly securing said housing to said door with said hasp received in said cavity.

12. The device of claim 10 wherein the locking means comprises a head, the head and a housing wall each having complementary tapered surfaces for receiving the head therein.

13. The device of claim 1 including a shield member secured to the housing for extending about the received locking body.

14. The device of claim 13 wherein said shield member comprises a rear wall and a pair of opposing lateral side walls.

15. The device of claim 14 including a further rear wall and fastening means extending from the rear walls for securing the housing to the door.

16. A device for locking an enclosure door keeper bar rotatable to door open and closed states in a closed locked state, the device for receiving a bolt seal having a shank, a head and a locking body for locking the keeper bar closed, the device comprising:

a hasp including at least one plate member leg, the leg having a shank receiving aperture, the leg for fixed attachment to the keeper bar;

a housing comprising front and rear walls, first and second opposing lateral side walls, top and bottom plate members defining a cavity for receiving said hasp and keeper bar, said walls and plate members for cooperating with said door for substantially enclosing said cavity, said first and second lateral side walls each having an aperture for receiving said shank, said head and locking body for securing the hasp to and between said first and second lateral side walls, said housing cooperating with said door to preclude rotation of the keeper bar in the locked state.

17. The device of claim 16 wherein the housing and the cavity are arranged so that the hasp and attached keeper bar are rotatable in said cavity.

18. The device of claim 16 including a shield member extending from the second lateral side wall.

19. The device of claim 16 including a further plate member overlying the first lateral side wall and secured to all said walls for forming a chamber therebetween, the further plate member having an aperture for passing the received head and shank therethrough, said first lateral side wall aperture for passing said shank and head therethrough so that the head in the received secured state is between the first lateral side wall and further plate member.

20. The device of claim 16 wherein the rear wall and top and bottom plate members extend from the second lateral side wall to partially surround the received locking body.

* * * * *